US010494835B1

(12) United States Patent
Lawson

(10) Patent No.: US 10,494,835 B1
(45) Date of Patent: Dec. 3, 2019

(54) DOOR HANDLE ATTACHMENT

(71) Applicant: Robert William Lawson, West Sacramento, CA (US)

(72) Inventor: Robert William Lawson, West Sacramento, CA (US)

( * ) Notice: Subject to any disclaimer, the term of this patent is extended or adjusted under 35 U.S.C. 154(b) by 0 days.

(21) Appl. No.: 16/130,122

(22) Filed: Sep. 13, 2018

(51) Int. Cl.
*E05B 1/00* (2006.01)
*E06B 9/52* (2006.01)
*E06B 3/46* (2006.01)

(52) U.S. Cl.
CPC ..... *E05B 1/0015* (2013.01); *E06B 9/52* (2013.01); *E05Y 2900/136* (2013.01); *E06B 3/4636* (2013.01)

(58) Field of Classification Search
CPC ... Y10T 16/458; E05B 1/0015; E05B 1/0053; E05B 1/003; B21D 28/10; B21D 53/38; A47B 95/02; A47B 2095/027
See application file for complete search history.

(56) References Cited

U.S. PATENT DOCUMENTS 2,447,389 A * 8/1948 Borchers ..... A47B 95/02 16/413
3,156,944 A * 11/1964 Bohn ..... E05B 1/0015 16/412
3,524,215 A * 8/1970 Kurtz ..... A47B 95/02 16/413
4,805,263 A * 2/1989 Kurtz ..... E05B 1/0015 16/443
D332,564 S * 1/1993 Santosuosso ..... E05B 1/0015 D8/314
5,379,821 A * 1/1995 Pergolizzi ..... E05B 1/0015 160/371
5,927,018 A * 7/1999 Thain ..... E05B 53/001 16/86 R
6,189,183 B1 * 2/2001 Hartselle, III ..... E05B 1/0015 16/412
6,382,750 B1 * 5/2002 King ..... A47B 95/00 16/901
8,752,334 B1 * 6/2014 Vanduch ..... E05B 53/001 16/422
D779,910 S * 2/2017 Paquette ..... E05B 53/001 D8/308
9,714,524 B2 * 7/2017 Parish-Allaire ..... E05B 1/0015
9,822,572 B2 * 11/2017 Brown ..... E05F 11/54
2009/0145037 A1 * 6/2009 Michael ..... E05F 11/54 49/359
2015/0067987 A1 * 3/2015 Herman ..... E05B 1/0015 16/412

* cited by examiner

*Primary Examiner* — Chuck Y Mah
(74) *Attorney, Agent, or Firm* — ONE LLP

(57) ABSTRACT

A door handle attachment is provided having (1) at least one lateral support member, (2) a handle ridge, and (3) an adhesive backside. The lateral support members are coupled along one longitudinal edge at a substantially right angle to the handle ridge, such that the handle ridge rises up away from the lateral support members. The adhesive backside is formed from the posterior surface, i.e. the underside of the lateral support members, and is substantially coated with an adhesive.

16 Claims, 9 Drawing Sheets

DOOR HANDLE ATTACHMENT

FIELD OF THE INVENTION

The invention generally relates to attachments to doors that may be used, for example, to make doors easier to grasp, open, or close.

BACKGROUND OF THE INVENTION

Sliding doors have been elements of private and public architecture since antiquity. For example, archeologists believe sliding doors were used in Ancient Roman construction dating to at least the 1st Century CE, and the iconic sliding shoji has been a staple of traditional Japanese architecture since around the 8th Century CE. Some advantages of sliding doors include the ability to conserve space over common swinging or bifold doors; the ability to conceal an open door; enhanced flow of light; soundproofing; and aesthetic considerations.

Contemporary sliding doors come in a variety of styles and materials. Traditionally-styled sliding doors typically include two or more panel sections, at least one fixed and one mobile, such that the mobile panel slides across the face of the fixed panel. Some styles include disappearing or "pocket" doors, which slide into a concealed cavity in a hollow wall space. Sliding doors come in, for example, indoor solid styles, or glass patio styles, also called "Acadia" styles. Many sliding door panel sections are made with rectangular frame suspending a taut mesh screen. Such mesh screen door panels permit air to flow between the interior and exterior of a space, while preventing the free ingress and egress of, for example, leaves and detritus, insects and spiders, wild animals, household pets, and children. However, such mesh screens are often somewhat fragile and present a high risk of tearing, puncturing, or separating from the frame.

SUMMARY OF THE INVENTION

The present invention provides a door attachment device which includes a handle ridge that a user may grip for improved ease of opening and closing of sliding doors, and for improving the durability of mesh screen door panels. The invention may be used in many suitable varieties of sliding fixture applications.

In one aspect, the invention provides a door handle attachment comprising (1) a substantially planar lateral support member comprising one or more (e.g., 2, 3, 4, 5, 6, or more) lateral support wings and having a front side and a back side, (2) a handle ridge extending from the front side, and (3) an adhesive back side. The door handle attachment generally, and the lateral support member specifically (including the lateral support wings) may have any shape that is desirable and suitable for the intended application. Often, substantially rectangular devices (with square or rounded corners) will fit and be most aesthetically pleasing on standard sliding and screen doors. However, other shapes (e.g., round, oval, and polygonal) may be used and may vary depending upon the specific application and user preferences. The door handle attachment has any suitable length, preferably about 3-36 inches including about 3, 6, 8 10 12, 14, 16, 18, 20, 22, 24, 26, 28, 30, 32, 34, and 36 inches, and any suitable width approximately fitted for mounting to a door frame, preferably about 1-4 inches including about 1, 2, 3, 4 inches, or more. The lateral support member may have any thickness that is convenient provided that, when fabricated from the desired material, it has sufficient rigidity to function as described herein. Generally, the thickness of the lateral support member is kept to the minimum which maintains the desired rigidity and other performance characteristics.

As discussed elsewhere and understood by the skilled artisan, screen doors and other sliding doors on which the inventive door handle attachment is intended to be affixed often have a slim profile and are designed to pass into a narrow opening (e.g., in the case of a pocket door) or in close proximity to another sliding door (e.g., as is the case for the interior-facing aspect of a screen door and the exterior facing aspect of a solid (glass) sliding door). Thus, the total height of the door handle attachment, including the thickness of the lateral support member plus the height of the handle ridge, is designed so as to be less than the clearance between the two doors or the structural feature and door to which the attachment is affixed. In some embodiments, the lateral support member has a thickness of about 1/16" to about 3/8" including about 1/16", 1/8", 3/16", 1/4", 5/16", and 3/8".

The handle ridge extends in a substantially perpendicular direction from the front side of the lateral support member. The handle ridge may run substantially the entire length of the lateral support member or just a portion of the length. Generally, the handle ridge will extend at least 50% of the length of the lateral support member including, for example, at least 60%, 70%, 75%, 80%, 90%, 95%, and 99%. The handle ridge may have any convenient height based on the characteristics of the door or door system to which the door handle attachment is intended to be affixed. Generally, the handle ridge will extend to a height (measured from the top face of the lateral support member front side) of about 1/4" to about 3" including about 1/4", 1/2", 3/4", 1", 1 1/4", 1 1/2", 1 3/4", 2", 2 1/4", 2 1/2", 2 3/4", and 3".

The back side of the lateral support member comprises an adhesive adapted for mounting the door handle attachment on the door of interest. The adhesive is selected to be compatible with (i.e., adhere to) to the material or outer surface of the door of interest and strong enough to withstand the repeated lateral forces on the door handle attachment without detaching from the door frame to which it is affixed. In some embodiments, the adhesive is a chemical adhesive, such as cyanoacrylate, epoxy, polyurethane, pressure-sensitive glue, wood glue, or hot glue.

In one aspect, the handle ridge is disposed longitudinally down the center of the lateral support member, such that the door handle attachment is substantially symmetrical. In an alternate aspect, the handle ridge is disposed in an off-set position from center such that the door handle attachment is asymmetrical. In still another aspect, the handle ridge extends from the longitudinal edge of the lateral support member. Asymmetry may be advantageous, for example, for saving material and therefore lowering cost and saving space. Asymmetry may also offer a preferred distribution of physical forces when the door handle attachment is in use.

The lateral support member and handle ridge may be made from metallic or non-metallic material. In one aspect, the lateral support member and handle ridge are made from galvanized aluminum. In a different aspect, the lateral support member and handle ridge are made from non-metallic material such as rubber, a thermoplastic polymer (plastic), composite, or carbon fiber.

The door handle attachment may be placed at any location on the leading edge of the sliding door. Optionally, a door handle attachment is installed on the interior side of the sliding door, the exterior side of the sliding door, or both. Optionally, two door handle attachments are installed on the interior side of the sliding door, the exterior side of the sliding door, or both. In some embodiments, the sliding door comprises a handle (e.g., a recessed handle) and a door handle attachment is installed above, below, or both above and below the handle on the interior side of the sliding door, exterior side of the sliding door, or both. In some embodiments, two door handle attachments are installed on the same side (interior, exterior, or both) of a sliding door and are positioned to abut each other thereby increasing the effective length of the door handle attachment. In other embodiments, two door handle attachments are installed on the same side (interior, exterior, or both) of a sliding door and are positioned above and below an existing handle mechanism such that neither door handle attachment interferes with the operation or use of that handle mechanism. When installing asymmetrical door handle attachments (including those with one or two lateral support wings), the handle ridge may be towards the front of the leading edge of the door frame or towards the back of the leading edge of the door frame.

In another aspect, the invention provides a sliding door comprising one, two, three, four, or more door handle attachment devices as described herein affixed to the leading edge of the sliding door. In some embodiments, the sliding door is a screen door. In other embodiments, the sliding door comprises one or two door handle attachment devices on the interior-facing surface of the sliding door, the exterior-facing surface of the sliding door, or both.

DESCRIPTION OF THE DRAWINGS

The present invention may be better understood by referring to the following figures. The components in the figures are not necessarily to scale, emphasis instead being placed upon illustrating the principles of the disclosure. In the figures, reference numerals designate corresponding parts throughout the different views.

DETAILED DESCRIPTION

Figure 1A:
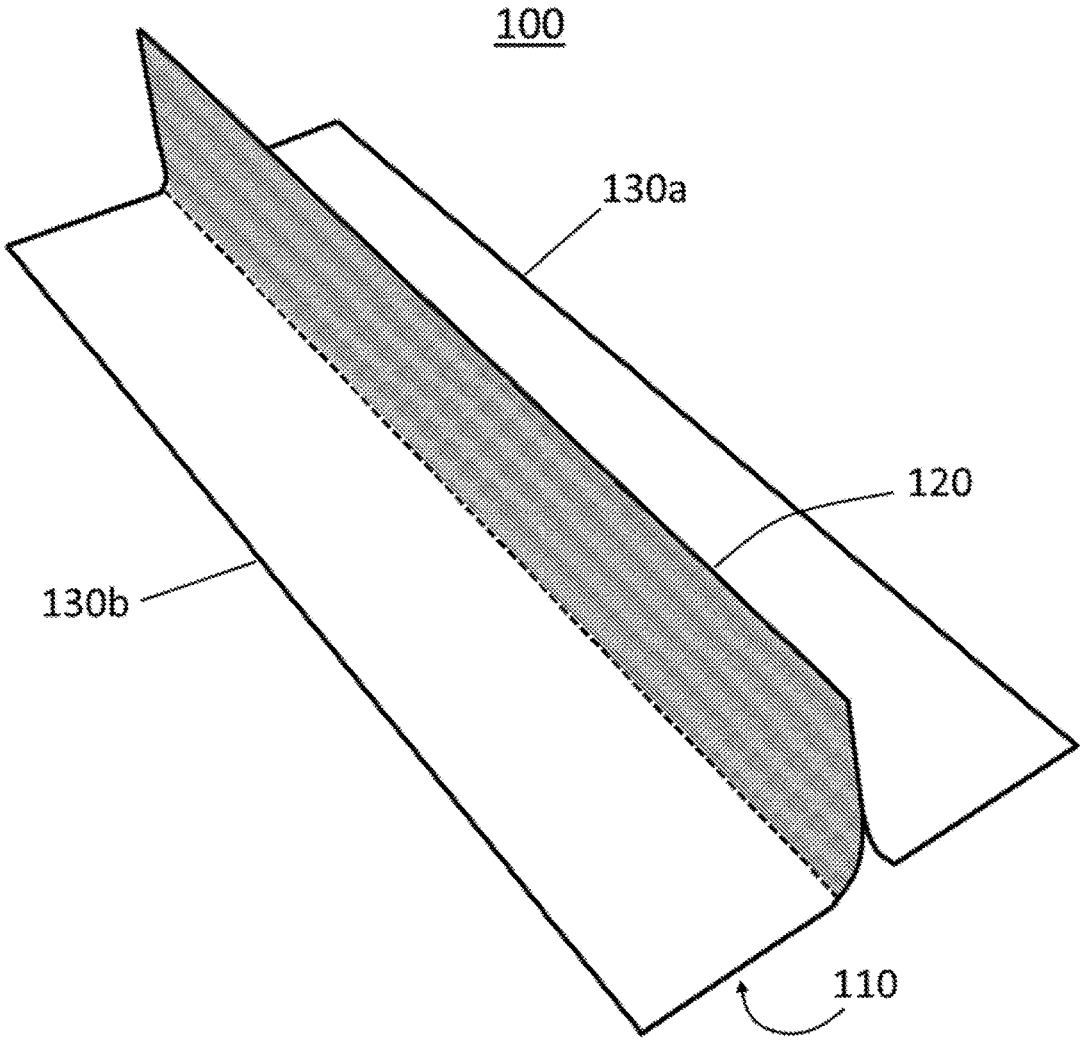
FIG. 1*a* is an isometric view of a door handle attachment that is substantially symmetrical.

The following description sets forth the invention and method of use in several embodiments. Those having ordinary skill in the art may be able to make alterations and modifications to what is described herein without departing from its spirit and scope. While this invention is susceptible to different embodiments in different forms, there is shown in the drawings and will herein be described in detail a preferred embodiment of the invention with the understanding that the present disclosure is to be considered as an exemplification of the principles of the invention and is not intended to limit the broad aspect of the invention to the embodiment illustrated. All features, elements, components, functions, and steps described with respect to any embodiment provided herein are intended to be freely combinable and substitutable with those from any other embodiment unless otherwise stated. Therefore, it should be understood that what is illustrated is set forth only for the purposes of example and should not be taken as a limitation on the scope of the present invention.

The present invention provides a door handle attachment that adheres to a sliding door. The invention provides a raised handle ridge, which a user may grip or to which a user may simply apply force for opening or closing a sliding door. It should be noted that a door is a non-limiting example and a person having ordinary skill in the art would understand that the present invention has uses on other fixtures.

Most contemporary North American sliding screen door designs do not include a raised ridge or other raised handle. Instead, most such screen door designs include a small recess in the door frame, e.g., rectangular in shape and roughly waist-high, which a user may reach in with the tips of her fingers to obtain a grip on the door frame for opening or closing. For door designs that include a lock or latch, the button or lever included for such a mechanism is usually presented inside this recessed grip.

Many users find the recessed grip cumbersome, uncomfortable, inefficient, or ineffective. Users who find the recessed grip unsatisfactory often choose to slide the door by grabbing the whole frame between the thumb and fingers. Such use is not intended by the manufacturer and is likely to increase wear-and-tear on the door, and for wire mesh screen doors is likely to cause the mesh screen to separate from the door frame. Some users may even choose to cease using the door.

Additionally, users of below average or above average height, particularly small children, may not be able to reach the recessed grip. Furthermore, persons in wheelchairs, persons having had amputations, persons having arthritis, persons having Parkinson's disease, and persons with other ailments or disabilities may find the recessed grip especially difficult to operate.

The present invention solves the above-stated problems by providing a door handle attachment with a raised ridge. A user may attach one or more door handle attachments to any preferred location on the sliding door. The raised handle ridge allows users to easily and conveniently apply force to both open and close a sliding door. The fact that the door attachment can easily be applied at any location on the sliding door allows users to offer a grip to children or very tall persons.

Furthermore, the raised ridge may by either gripped between the thumb and fingers or may simply be used as a surface against which to apply force to open or close the door. Accordingly, the raised ridge provides a convenient means to open or close a sliding door without requiring great strength or dexterity of the hands. For example, with the present invention a user could open or close a sliding door with a prosthetic hand or even a cane.

Figure 1B:
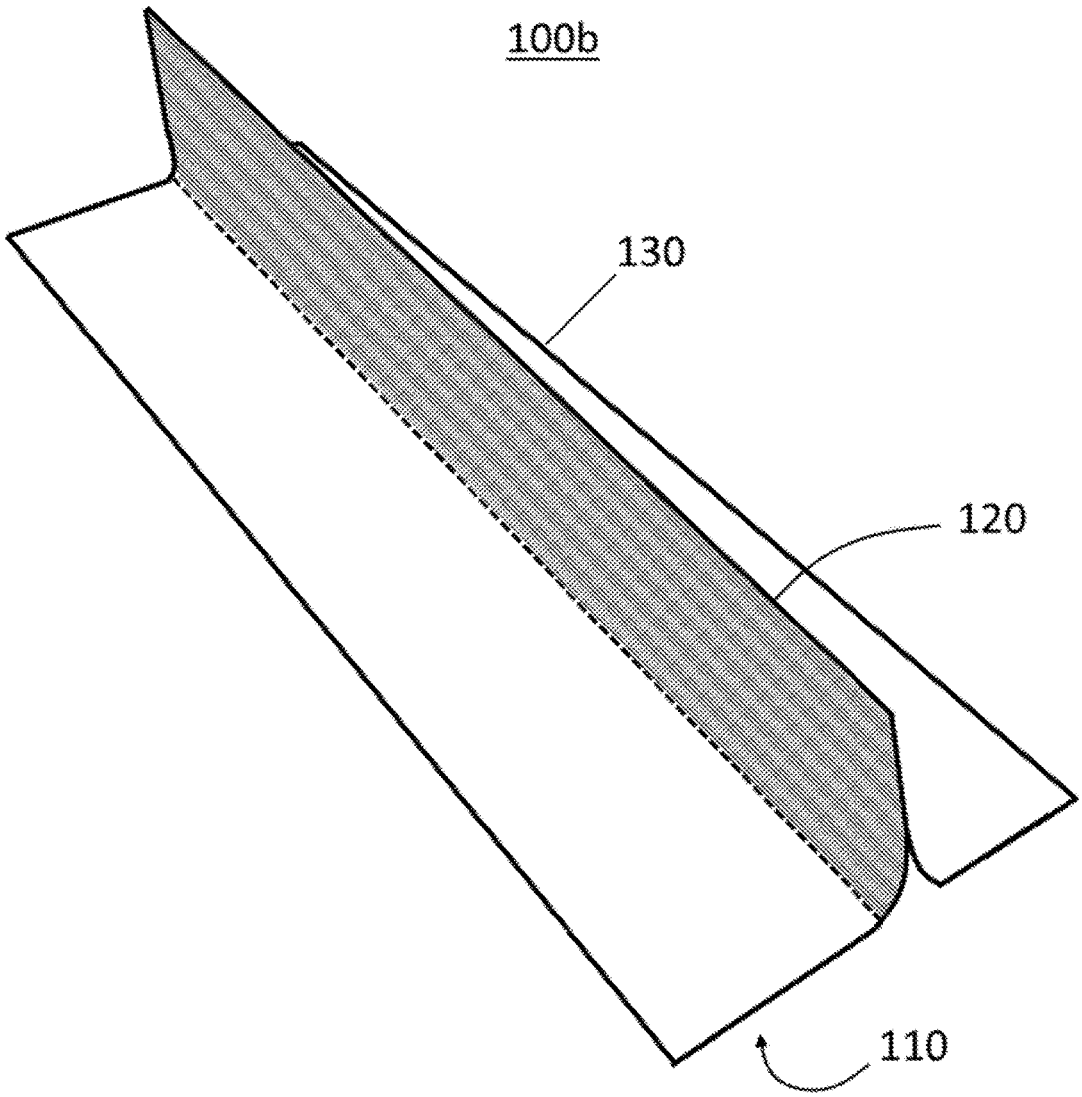
FIG. 1*b* is an isometric view of a door handle attachment that is asymmetrical.

Turning to the drawings, FIG. 1*a* illustrates a door handle attachment 100*a*. The door handle attachment 100 is substantially rectangular in shape and includes a lateral support member comprising lateral support wings 130*a*, 130*b*, a handle ridge 120 and an adhesive backside 110. Handle ridge 120 is disposed longitudinally down door handle attachment 100 on the front side. In some embodiments, handle ridge 120 extends from the front side at a substantially 90-degree angle relative to the lateral support member 130 (including lateral support wings 130*a*, 130*b*). In some embodiments, such as the one depicted in FIG. 1*a*, the handle ridge 120 is positioned approximately centered along the lateral support member 130 such that lateral support wings 130*a*, 130*b* have the same width, yielding a substantially symmetrical configuration of door handle attachment 100. In alternative embodiments, such as the one depicted in FIG. 1*b*, the handle ridge 120 is positioned off-center along the lateral support member 130 such that lateral support wings 130*a*, 130*b* have different widths, yielding an asymmetrical door handle attachment 100*b*. In still another embodiment, the handle ridge 120 may be positioned at the edge of the door handle attachment 100 such that lateral support member 130 comprises only a single lateral support wing 130*a* (i.e., lateral support wing 130*b* is absent), as shown for example in FIG. 3*c*).

In some embodiments, the handle ridge 120 may be the same or substantially similar length as lateral support member 130. In other embodiments, the handle ridge 120 may extend less than the whole length of the lateral support member 130. In some embodiments, the handle ridge 120 is substantially straight, while in other embodiments, the handle ridge 120 is crimped or provided with groves substantially conforming to a user's thumb and fingers. In one preferred embodiment, the door handle attachment 100*a* is a single piece of crimped metal, and the handle ridge 120 is formed from the crimped portion of the material.

The back side of the door handle attachment 100 (i.e., the back side of lateral support member 130 including lateral support wings 130 *a,b*) comprises an adhesive 110. The adhesive backside 110 is a generally flat surface that may be coated with a chemical or mechanical adhesive suitable for mounting the door handle attachment onto a fixture such as a door frame. Non-limiting examples of chemical adhesives suitable for coating the adhesive backside 110 include cyanoacrylate, epoxy, polyurethane, rubber cement, pressure-sensitive glue, fabric glues, hot glue, spray glue, wood glue, and wax.

Door handle attachment 100 may be made from any suitable metallic or non-metallic material or combination of materials. For example, in a preferred embodiment, the structure of the door handle attachment 100 is made from galvanized aluminum. Other non-limiting examples of suitable metallic materials include ungalvanized aluminum, iron, steel, brass, nickel, Monel metal, copper, bronze, tin, or lead. Some non-limiting examples of non-metallic materials include rubber, plastic, urethane, wood, carbon fiber, or composite. In some embodiments, the handle ridge 120 and lateral support member are made from the same material. In other embodiments, the handle ridge 120 is made from one selected material, and the lateral support member 130 are made from a different material. The door handle attachment 100 may be uncoated or may be optionally coated in any desired color of paint, primer, sealant, plating, or protectant, such as, e.g., by electrostatic coating or electroplating.

Figure 2A:
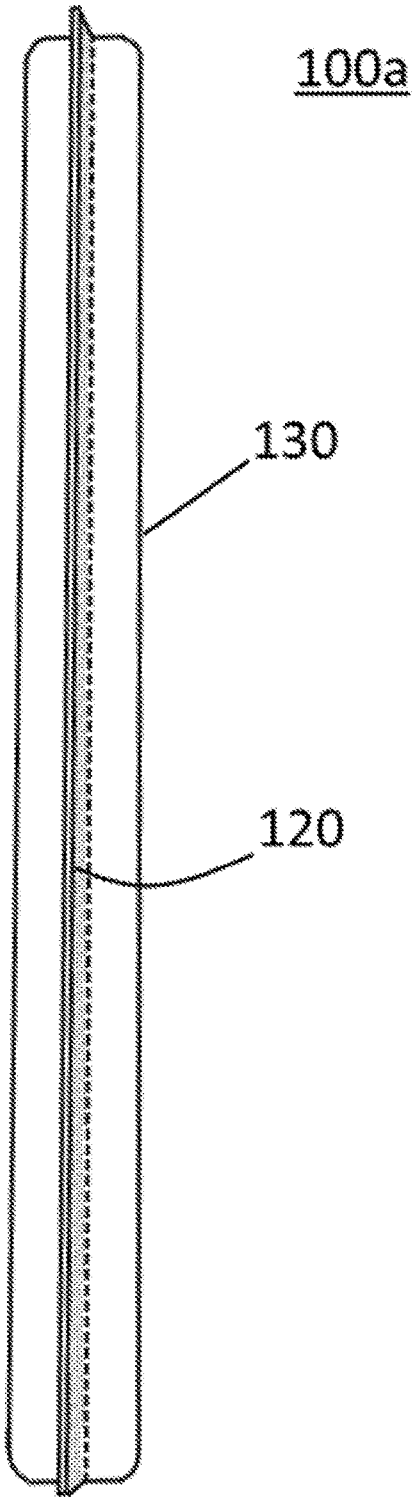
FIG. 2*a* an orthogonal overhead view of a door handle attachment that is substantially symmetrical.
Figure 2B:
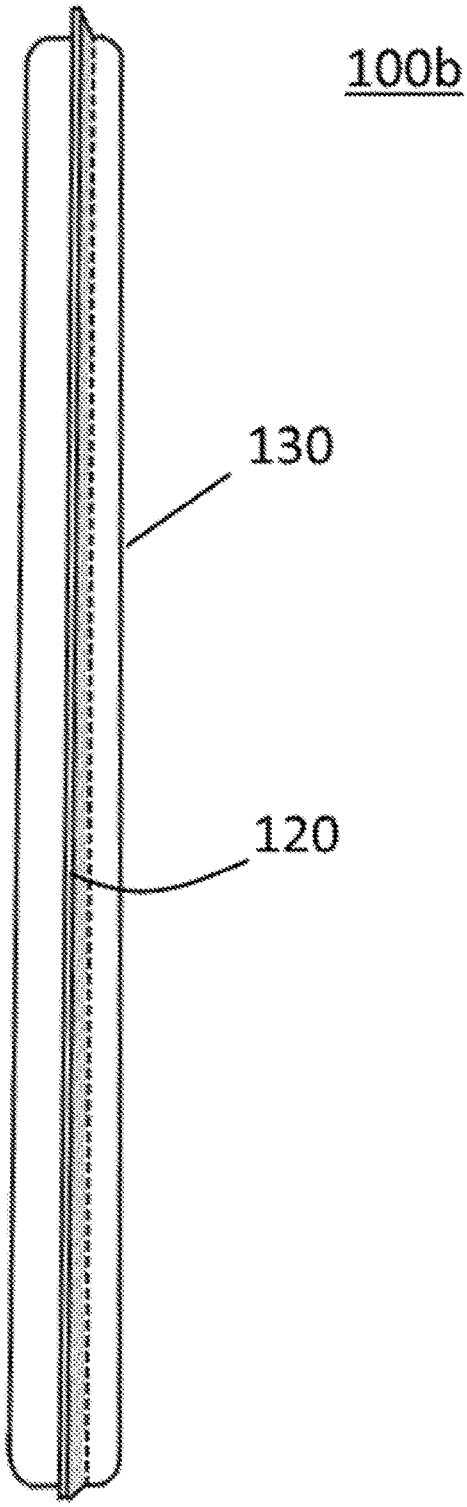
FIG. 2*b* is an orthogonal overhead view of a door handle attachment that is asymmetrical.

FIG. 2*a* provides a general illustration of the dimensions of door handle attachment 100*a*. The door handle attachment 100*a* is generally elongated. In a preferred embodiment, the lateral support wings 130*a*, 130*b* are approximately 0.25 to 4 inches wide and approximately 6 to 36 inches long, and the handle ridge 120 is raised a suitable height from the surface of the lateral support members 130*a*, 130*b*. As illustrated in FIG. 2*b*, an asymmetric door handle attachment 100*b* having lateral support members 130*a*, 130*b* of non-equal widths may also be provided.

Embodiments of the door handle attachment 100 may be produced by crimping a single piece of workable material, such as galvanized aluminum, folding the single piece to create handle ridge 120 such that lateral support wings 130*a*, 130*b* are discontinuous. In another aspect, two or more pieces are joined, e.g., by welding. In still another aspect, a single piece is made from injection molding, casting, or 3D printing.

Figure 3A:
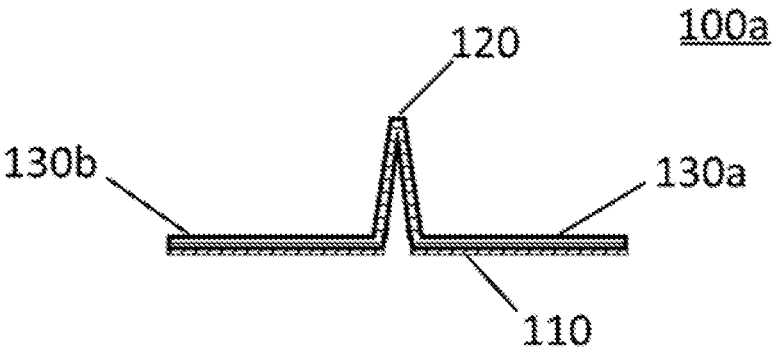
FIG. 3*a* is a cross section of a crimped-style door handle attachment that is substantially symmetrical.
Figure 3B:
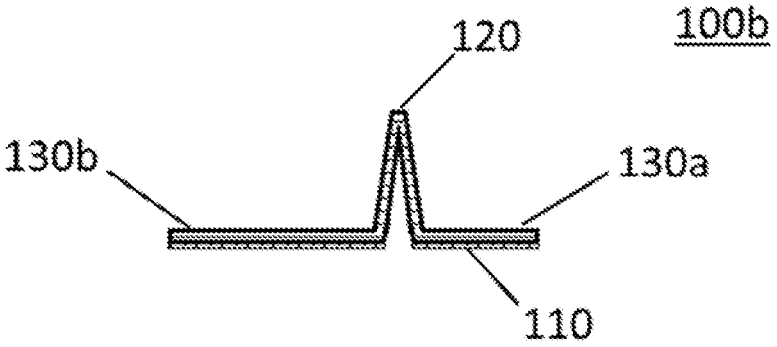
FIG. 3*b* is a cross section of a crimped-style door handle attachment that is asymmetrical.
Figure 3C:
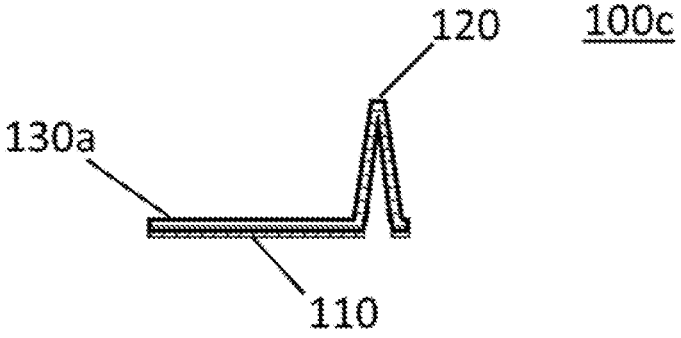
FIG. 3*c* is a cross section of a crimped-style door handle attachment wherein the handle ridge is coupled to the edge of the lateral support member.

FIGS. 3*a*, 3*b*, and 3*c* illustrate various cross sections of crimped-style door handle attachments. The illustrated embodiments are generally made from a single piece of crimped material, forming the lateral support wings 130*a*, 130*b* and handle ridge 120. The handle ridge 120 forms the cross-sectional shape of an inverted V (i.e., Greek capital letter A). FIG. 3*a* depicts a symmetrical embodiment with the handle ridge 120 approximately centered on the door handle assembly 100 such that lateral support wings 130*a*, 130*b* have an approximately equal width. FIG. 3*b* depicts an asymmetric embodiment with the handle ridge 120 off-set from the center/midline of door handle assembly 100 such that lateral support wings 130*a*, 130*b* have different widths. FIG. 3*c* depicts a cross section of a crimped-style door handle attachment wherein handle ridge 120 extends from the longitudinal edge of a lateral support member 130 such that door handle assembly 100*c* has only a single lateral support wing 130*a* (i.e., lateral support wing 130*b* is absent). The depicted adhesive backside 110 is generally coated with a chemical adhesive, but alternatively may be disposed with physical fixative or adhesive elements such as loop-and-pile fasteners. Note that the cross section is not presented to scale and is intended for illustrative purposes.

Figure 3D:
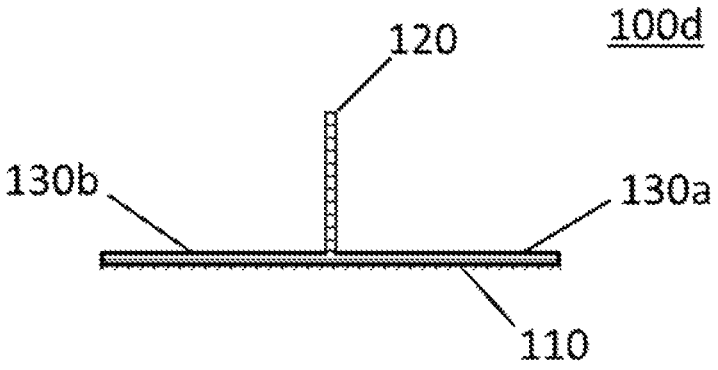
FIG. 3*d* is a cross section of a T-shaped door handle attachment that is substantially symmetrical.
Figure 3E:
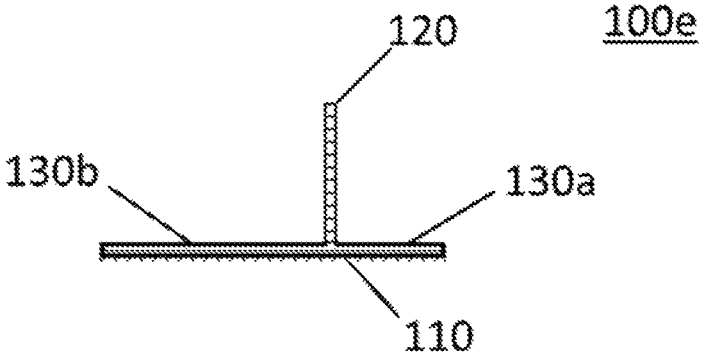
FIG. 3*e* is a cross section of a T-shaped door handle attachment that is asymmetrical.
Figure 3F:
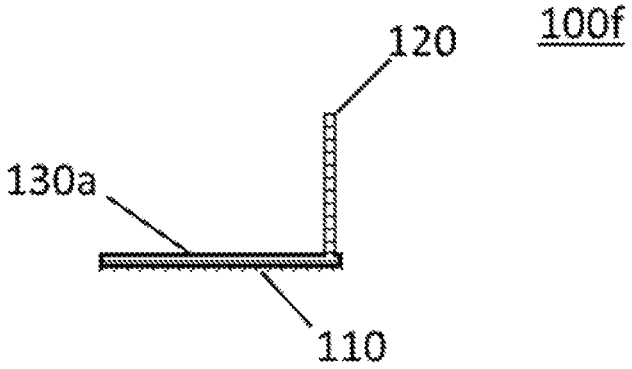
FIG. 3*f* is a cross section of an L-shaped door handle attachment wherein the handle ridge is coupled to the edge of the lateral support member.

FIGS. 3*d*, 3*e*, and 3*f* illustrate various cross sections of T-shape/L-shape style door handle attachments in which the lateral support wings 130*a,b* are continuous/contiguous. The illustrated embodiments are generally made from a single piece of molded, cast, or 3D printed material. FIG. 3*d* depicts a symmetrical embodiment of a T-shape style door handle attachment with the handle ridge 120 approximately centered on lateral support member 130 such that lateral support wings 130*a*, 130*b* have an equal width. FIG. 3*e* depicts an asymmetric embodiment of a T-shape style door handle attachment with the handle ridge 120 off-set from the center of lateral support member 130 such that lateral support wings 130*a*, 130*b* have an unequal width. FIG. 3*f* depicts an L-shape style door handle attachment wherein the handle ridge extends from the longitudinal edge of a lateral support member 130. The depicted adhesive backside 110 is generally coated with a chemical adhesive, but alternatively may be disposed with physical fixative or adhesive elements such as loop-and-pile fasteners. Note that the cross section is not presented to scale and is intended for illustrative purposes.

Figure 4A:
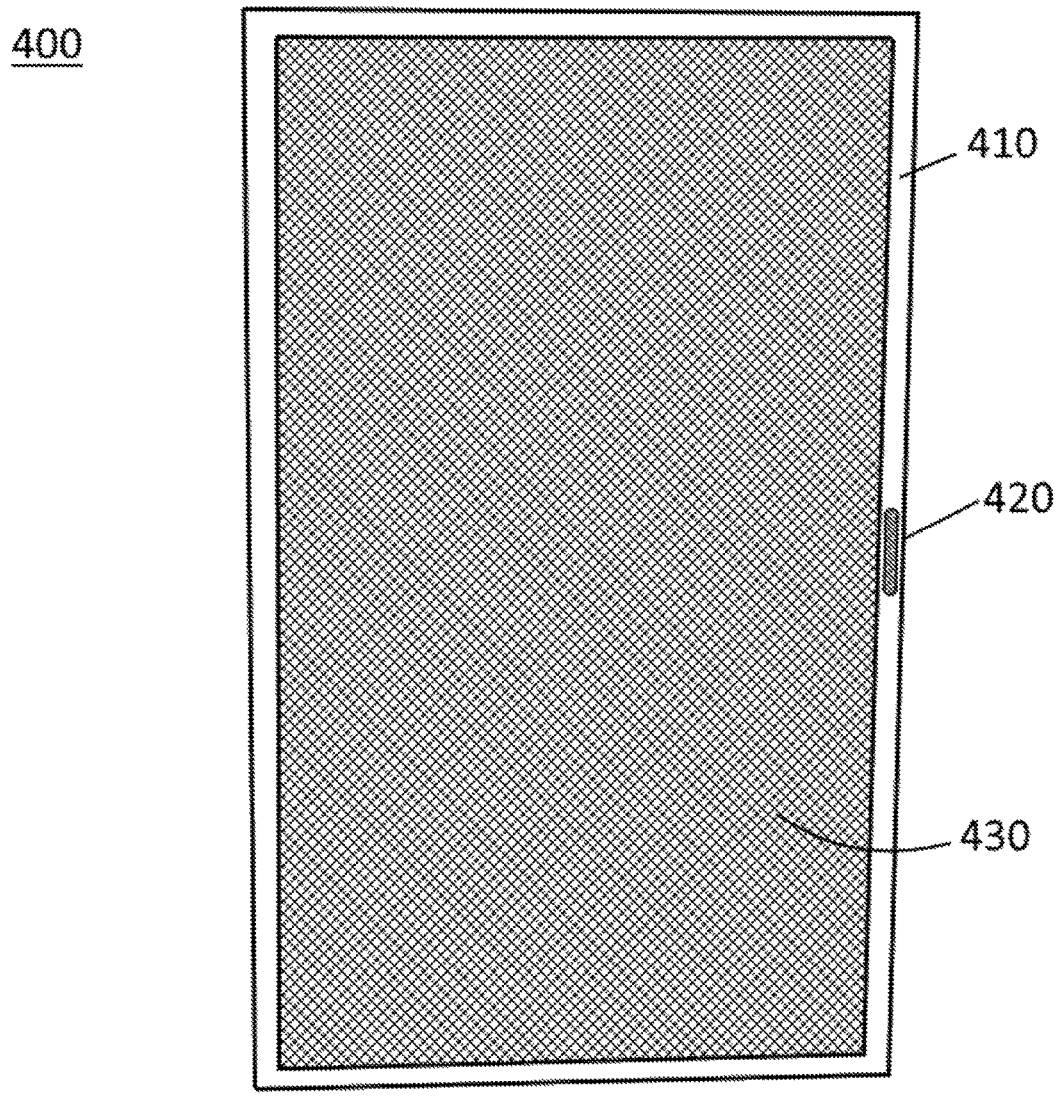
FIG. 4*a* is a frontal view of an example of a screen door panel.
Figure 4B:
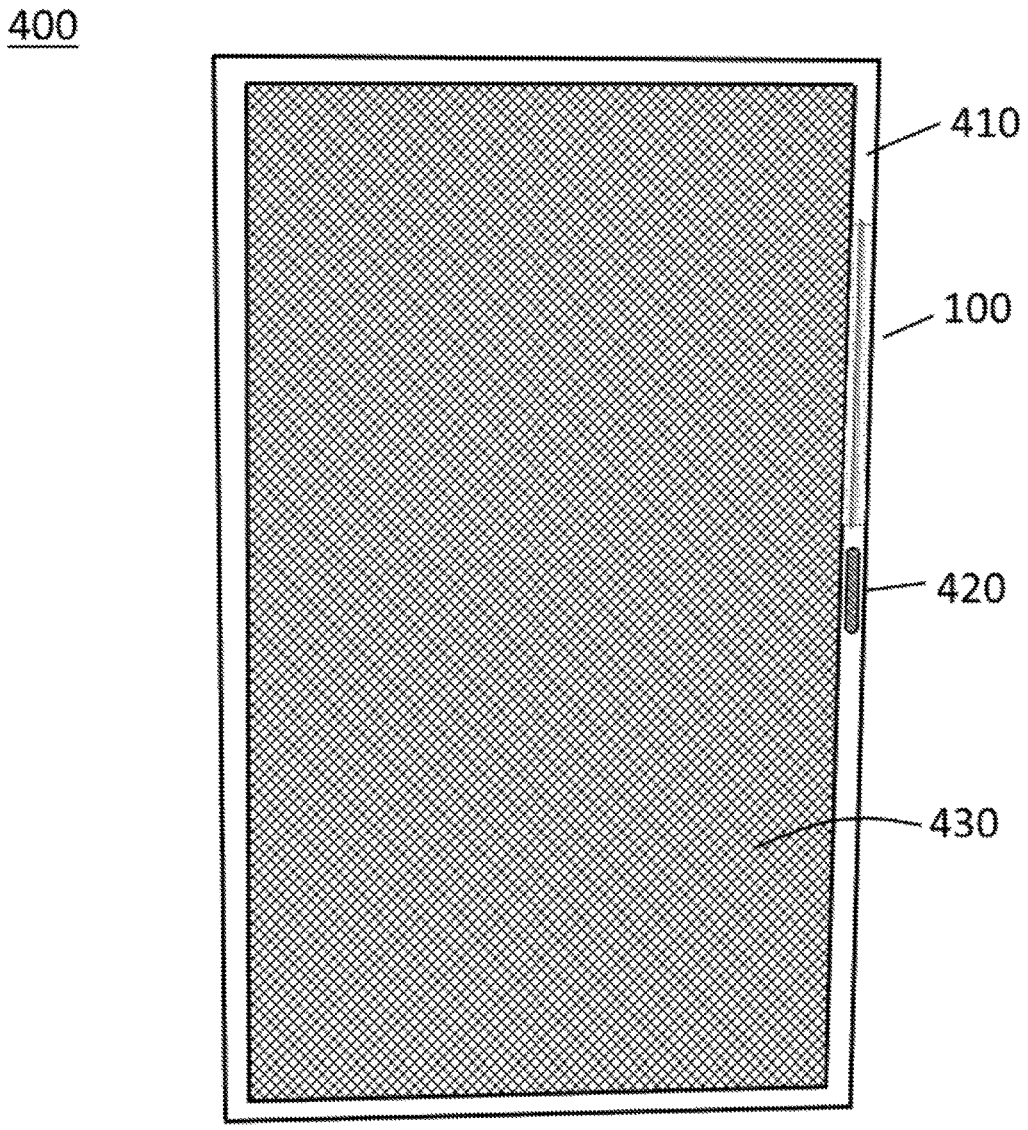
FIG. 4*b* is a frontal view of a screen door panel having the door handle attachment coupled above the frame recess.
Figure 4C:
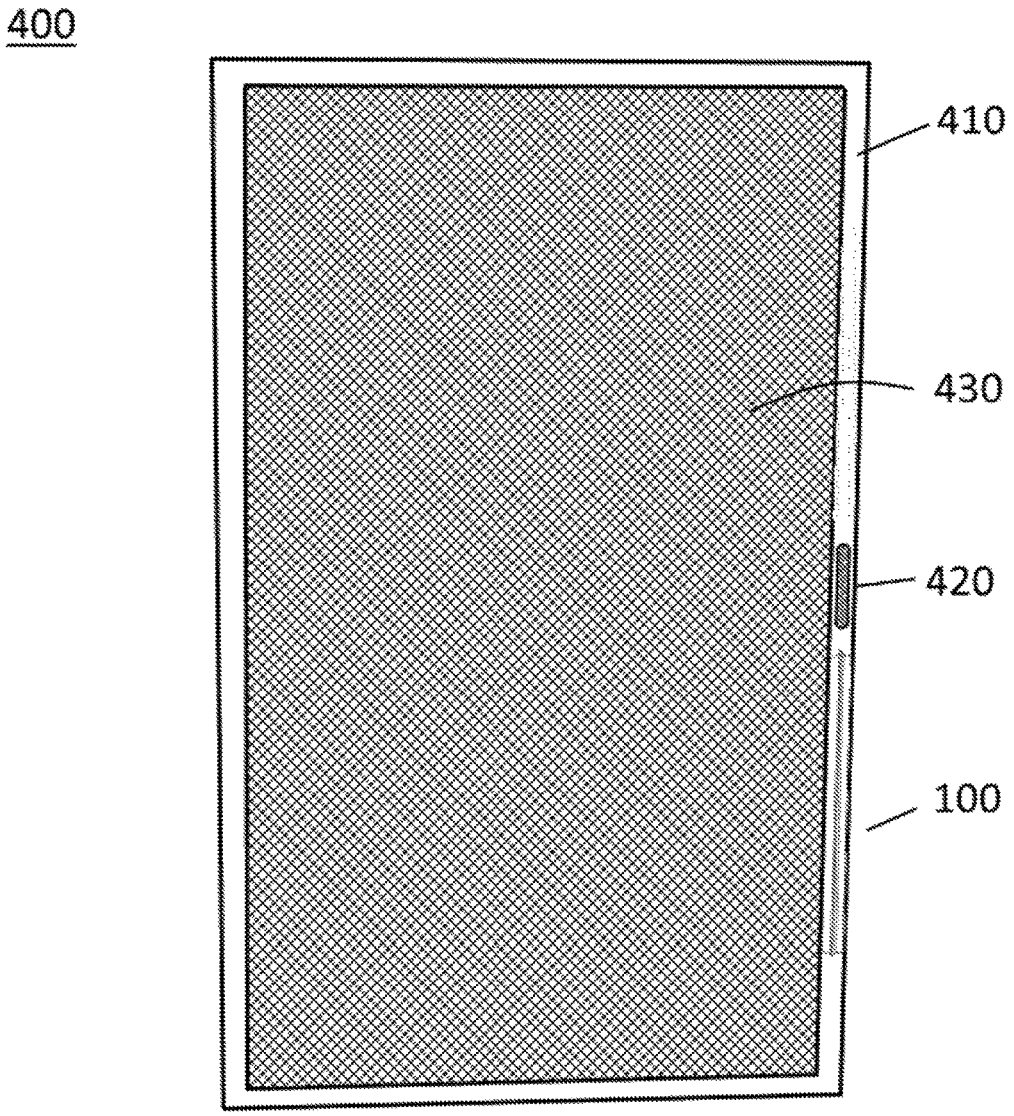
FIG. 4*c* is a frontal view of a screen door panel having the door handle attachment coupled below the frame recess.
Figure 4D:
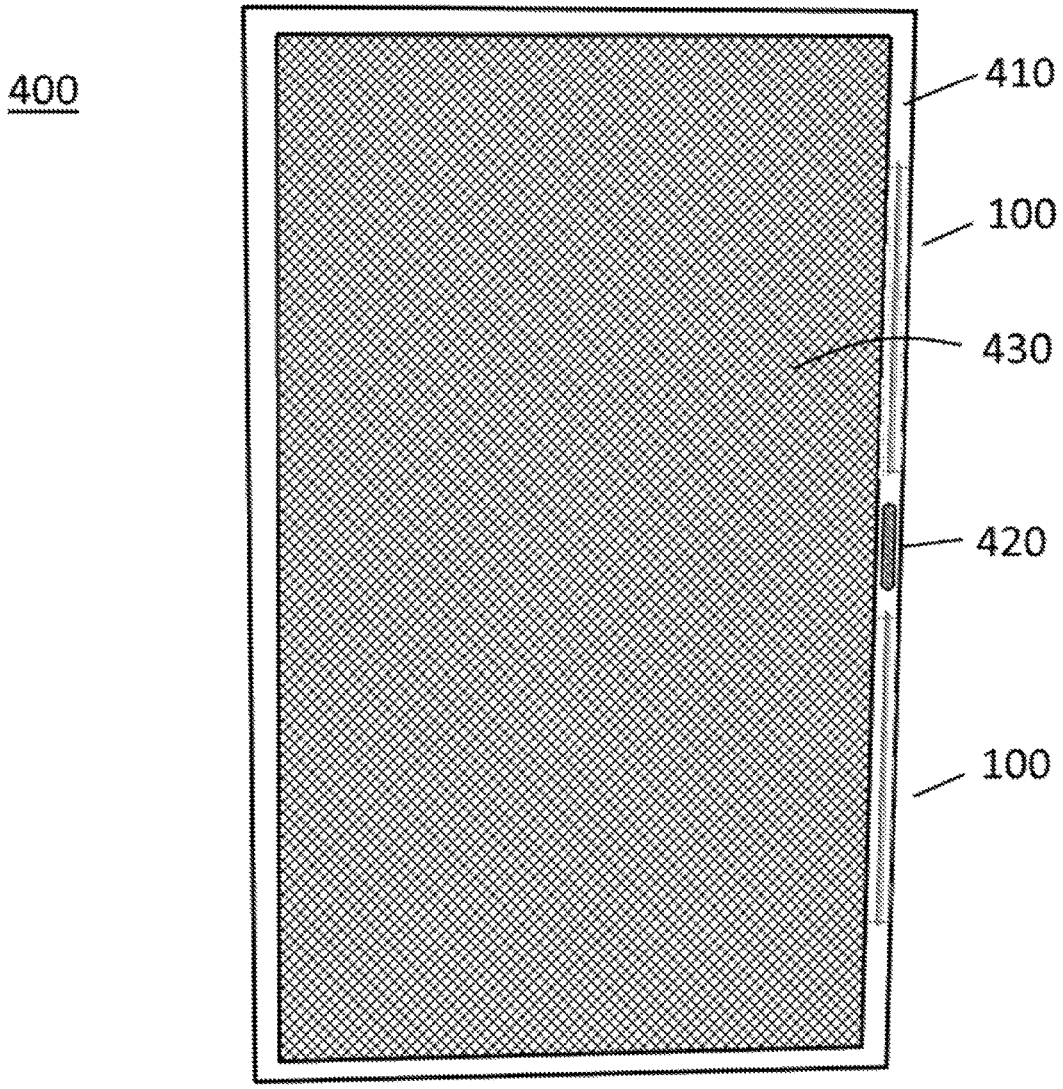
FIG. 4*d* is a frontal view of a screen door panel having two door handle attachments, coupled above and below the frame recess.

FIG. 4*a* illustrates one example of a standard mesh-screen sliding door 400 having a substantially rigid rectangular frame 410, the frame having on one vertical member a recessed handgrip 420, and the frame suspending a taut mesh screen 430. FIG. 4*b* illustrates such a sliding door 400 having the door handle attachment 100*a* adhered to the frame 410 above the recessed handgrip 520. FIG. 4*c* illustrates the same, except having the door handle attachment 100 adhered below the recessed handgrip 420. FIG. 4*d* illustrates the same, except having two door handle attachments 100, one adhered to the frame 510 above the recessed handgrip 420 and one adhered to the frame below the recessed handgrip 420. Having two door handle attachments 100 adhered to the door frame 410 may be advantageous in a household having small children, for example. It is understood that one or more of the door handle attachments 100 may be affixed to the interior-facing surface of the sliding door, the exterior-facing surface of the sliding door, or both, depending upon the user's preference.

It will be appreciated by persons having ordinary skill in the art that many variations, additions, modifications, and other applications may be made to what has been particularly shown and described herein by way of embodiments, without departing from the spirit or scope of the invention. Therefore, it is intended that scope of the invention, as defined by the claims below, includes all foreseeable variations, additions, modifications or applications.

What is claimed is:

1. A device comprising:

a substantially planar lateral support base member having a length of at least 12 inches and a width of not more than 4 inches, and a front face and a back face, wherein the back face comprises an adhesive backing, and wherein the front face comprises a handle ridge running at least 50% of the length of the lateral support base member, extending in a substantially perpendicular direction from the front face, and having a height of ¼ inches to 3 inches.

2. The device of claim 1, wherein the front face comprises two lateral support wings and a central handle ridge.

3. The device of claim 2, wherein the two lateral support wings are symmetrical.

4. The device of claim 2, wherein the two lateral support wings are asymmetrical.

5. The device of claim 2, wherein the handle ridge extends at least 90% of the length of the lateral support base member.

6. The device of claim 1, wherein the handle ridge extends at least 90% the length of the lateral support base member and is disposed on an edge of the lateral support base member.

7. A sliding door comprising the device of claim 1 affixed to a frame of the sliding door.

8. The sliding door of claim 7, wherein the sliding door comprises a mesh-screen.

9. A device comprising:

a substantially planar lateral support base member having a length and a width, and a front face and a back face, wherein the ratio of length to width is at least 3:1, wherein the back face comprises an adhesive backing, and wherein the front face comprises a handle ridge running at least 50% of the length of the lateral support base member, extending in a substantially perpendicular direction from the front face, and having a height of ¼ inches to 3 inches.

10. The device of claim 9, wherein the front face comprises two lateral support wings and a central handle ridge.

11. The device of claim 10, wherein the two lateral support wings are symmetrical.

12. The device of claim 10, wherein the two lateral support wings are asymmetrical.

13. The device of claim 10, wherein the handle ridge extends at least 90% of the length of the lateral support base member.

14. The device of claim 9, wherein the handle ridge extends at least 90% the length of the lateral support base member and is disposed on an edge of the lateral support base member.

15. A sliding door comprising the device of claim 9 affixed to a frame of the sliding door.

16. The sliding door of claim 15, wherein the sliding door comprises a mesh-screen.

* * * * *